United States Patent [19]

Becker et al.

[11] 4,303,014

[45] Dec. 1, 1981

[54] STORAGE CYLINDER

[75] Inventors: Willi Becker; Arno Wirz, both of Bammental, Fed. Rep. of Germany

[73] Assignee: Heidelberger Druckmaschinen Aktiengesellschaft, Heidelberg, Fed. Rep. of Germany

[21] Appl. No.: 46,058

[22] Filed: Jun. 6, 1979

[30] Foreign Application Priority Data

Jun. 6, 1978 [DE] Fed. Rep. of Germany ..... 2824733

[51] Int. Cl.[3] ..... B41F 1/30

[52] U.S. Cl. ..... 101/409

[58] Field of Search ..... 101/409, 410, 230, 232, 101/246, 142; 271/82, 277

[56] References Cited

U.S. PATENT DOCUMENTS 3,654,861 4/1972 Rudolph et al. ..... 101/409 X 4,026,209 5/1977 Wirz et al. ..... 101/410 X

FOREIGN PATENT DOCUMENTS 1455756 11/1976 United Kingdom ..... 101/409

*Primary Examiner*—E. H. Eickholt

*Attorney, Agent, or Firm*—Herbert L. Lerner

[57] ABSTRACT

In a transfer cylinder for perfector printing machines having two diametrically opposed sheet-supporting surfaces formed from two groups, respectively, of sheet supports engaging comb-like one within the other, one of the two sheet-supporting groups of one sheet-supporting surface having a device for gripping the leading edge of a sheet, and both of the sheet-supporting groups forming one sheet-supporting surface being adjustable relative to one another about the rotary shaft of the transfer cylinder, each of the sheet supports of a respective sheet-supporting surface being firmly connected to a diametrically opposing sheet support of the other sheet-supporting surface and being disposed on the shaft of the transfer cylinder, the improvement therein includes means for mounting together at least a plurality of the diametrically opposing, mutually firmly connected sheet supports so as to be radially adjustable.

5 Claims, 8 Drawing Figures

STORAGE CYLINDER

The invention relates to a storage or transfer cylinder for perfector printing machines and, more particularly, such a cylinder having two diametrically opposed sheet-supporting surfaces formed from two groups, respectively, of sheet supports engaging comb-like one within the other, one of the two sheet supporting groups of one sheet-supporting surface having a device for gripping the leading edge of a sheet, and both of the sheet-supporting groups forming one sheet-supporting surface being adjustable relative to one another about the rotary shaft of the transfer cylinder, each of the sheet supports of a respective sheet-supporting surface being firmly connected to a diametrically opposing sheet support of the other sheet-supporting surface and being disposed on the shaft of the transfer cylinder.

The manufacture of transfer cylinders of the foregoing type demands very great accuracy because the sheets transported by both sheet-supporting surfaces must be transferred exactly the same, otherwise double printing or mackling occurs.

The reason is as follows:

As a rule, such transfer cylinders are formed of a stationary cylinder part with two diametrically opposed devices for gripping the leading edge of a sheet and a cylinder part adjustable about the axis of rotation or rotary shaft of the transfer cylinder and having two likewise diametrically opposing devices for gripping the trailing edge of a sheet. The respectively transported sheet lies flatly on the sheet supporting surface. Under certain conditions, suction devices, for example, are provided to ensure this disposition of the sheet. If one of the sheet-supporting surfaces should then be located higher than the other due to faults in concentric running and form or shape, the position of the last printed edge of a pair of succeeding sheets falls out differently. The result thereof is a rhythmic double printing or mackling in the print after sheet turn-over. A concentric running fault of 0.02 mm, for example, depending upon the sheet length, can cause double printing or mackling of about 0.05 mm.

With perfector printing machines heretofore known in commerce, a possible difference in height of the sheet supporting surfaces of the transfer cylinder, determined after a printing has occurred, is compensated for by gluing adhesive strips, such as aluminum foils, for example, to the lower sheet-supporting surface. The adhesive strips can loosen however, due to cleaning of the surface. Furthermore, application of the diverse adhesive strips is troublesome and time-consuming.

It is accordingly an object of the invention of the instant application to provide a storage or transfer cylinder of a perfector printing machine with means by which double printing or mackling phenomena resulting from concentric running and form faults of the transfer cylinder after the machine has printed are eliminated.

With the foregoing and other objects in view, there is provided, in accordance with the invention, a transfer cylinder for perfector printing machines having two diametrically opposed sheet-supporting surfaces formed from two groups, respectively, of sheet supports engaging comb-like one within the other, one of the two sheet-supporting groups of one sheet-supporting surface having a device for gripping the leading edge of a sheet, and both of the sheet-supporting groups forming one sheet-supporting surface being adjustable relative to one another about the rotary shaft of the transfer cylinder, each of the sheet supports of a respective sheet-supporting surface being firmly connected to a diametrically opposing sheet support of the other sheet-supporting surface and being disposed on the shaft of the transfer cylinder, and means for mounting together at least a plurality of the diametrically opposing, mutually firmly connected sheet supports so as to be radially adjustable.

In this manner, it is not only possible to compensate for concentric running and form faults but also to correct subsequent variations in the adjustable parts of the transfer drum.

In accordance with another feature of the invention, two diametrically opposing sheet-supporting groups form a cylinder base member and each thereof has a device for gripping the leading edge of a sheet, both of the other sheet-supporting groups being disposed on a hollow member partly surrounding the cylinder base member and, respectively, having a device for gripping the trailing edge of a sheet, two cylinder journals provided on the cylinder base member and carrying respective slide rings, the hollow member being mounted on the cylinder journals through the intermediary of the slide rings, the slide rings and the cylinder journal having play therebetween, set screws disposed in the hollow member and acting upon the slide rings so as to deform the same for locally removing the play between the inner surface of the slide rings and the bearing surface of the respective cylinder journal and for radially adjusting the sheet supports.

The last-mentioned embodiment of the invention affords not only the radial adjustment of the entire sheet supporting surfaces, but also permits play-free adjustment and centric orientation of the adjustably disposed hollow member, in a very simple manner during initial assembly or during subsequent repair assemblies.

In accordance with a further feature of the invention, two diametrically opposing sheet-supporting groups are formed of sheet-supporting segments and each thereof has a device for gripping the leading edge of a sheet, both of the other sheet-supporting groups being likewise formed of individual sheet-supporting segments having a respective device for gripping the trailing edge of a sheet, at least a plurality of sheet-supporting segments being mounted through the intermediary of a slide ring on the shaft, the slide ring and the shaft having play therebetween, set screws disposed in the sheet-supporting segments provided with the slide ring and acting upon the slide ring so as to deform the same locally removing the play between the slide ring and the shaft and for radially adjusting the sheet support segments.

In accordance with an added feature of the invention, the setscrews are disposed so as to act directly upon said bearing surface or the shaft, as the case may be.

In accordance with a concomitant feature of the invention, setscrews are provided in said sheet-supporting combs and actuatable for deforming the sheet supports so as to radially adjust the free ends of the sheet supports.

The inventive features offer in addition to the advantage of compensating for concentric running and form faults, the possibility also of being able to adjust the individual sheet-supporting segments with respect to one another, in a relatively simply manner.

Other features which are considered as characteristic for the invention are set forth in the appended claims.

Although the invention is illustrated and described herein as embodied in storage cylinder, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing, in which.

Figure 1:
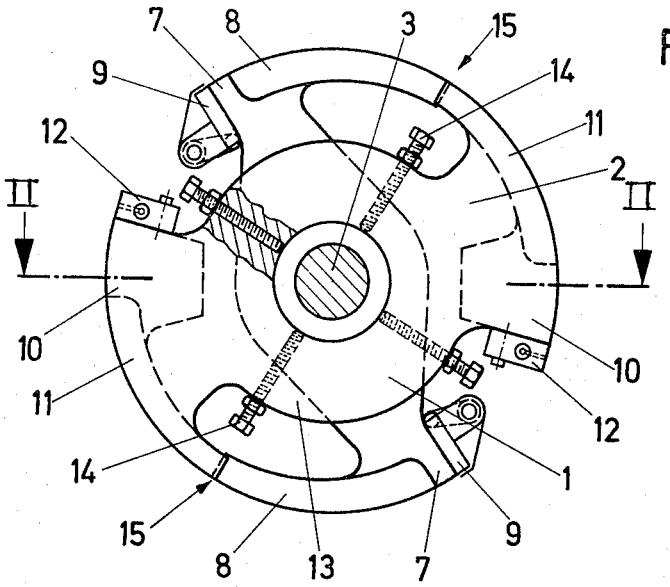
FIG. 1 is a side view of a transfer cylinder with two sheet-supporting surfaces, a part of the sheet-supporting surfaces being radially adjustable by setscrews.
Figure 2:
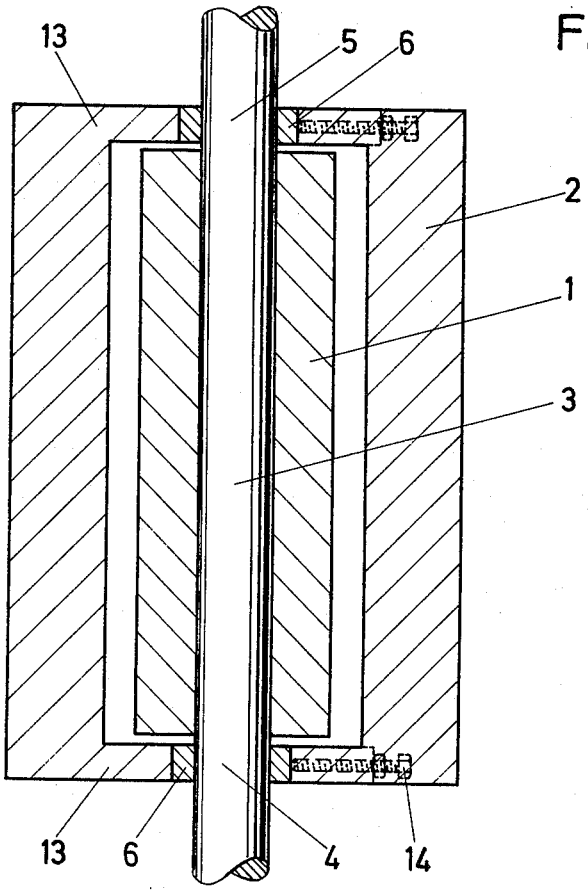
FIG. 2 is a longitudinal sectional view of FIG. 1 taken along the line II—II in direction of the arrows.

Referring now to the drawing and first, particularly to FIGS. 1 and 2 thereof, there is shown a first embodiment of a storage or transfer cylinder according to the invention which is formed primarily of two main parts, namely a cylinder base member 1 and a hollow member 2. The cylinder base member 1 is slipped firmly onto a shaft 3 having free cylinder journals 4 and 5 on which the hollow member 2 is rotatably mounted through the intermediary of respective slide or bearing rings 6.

The cylinder base member 1 is provided with two sheet-supporting combs 7 disposed diametrically opposite one another. Each of the sheet-supporting combs 7 is provided at one side thereof with comb-like sheet supports 8 and at the other side thereof with a device 9 for gripping the leading edge of a sheet.

The hollow member 2 is similarly provided with sheet-supporting combs 10 disposed diametrically opposite one another. Each of the sheet-supporting combs 10 is provided, at the side thereof facing toward the adjacent sheet-supporting comb 7, with sheet supports 11 which are disposed in comb-like fashion and, at the other side thereof, with a device 12 for gripping the trailing edge of a sheet.

In both bearing bosses or hubs 13 of the hollow member 2, the slide rings 6 mentioned hereinbefore are fastened by means of a press fit; in addition, four setscrews 14 are screwed into each of the bearing hubs 13 at locations uniformly distributed along the periphery thereof, the setscrews 14 acting upon the slide ring 6.

A respective sheet-supporting comb 7 and a respective sheet-supporting comb 10 together form a sheet-supporting surface 15. By adjusting the hollow member 2 with respect to the shaft 3, the sheet supports 8 and 11, which are staggered with respect to one another, can be slid into one another or, in the outer setting thereof according to FIG. 1, can be slid out of one another. The setting of the sheet-supporting combs 7 and 10 shown in FIG. 1 corresponds to the largest sheet format available for the transfer cylinder.

Figure 3:
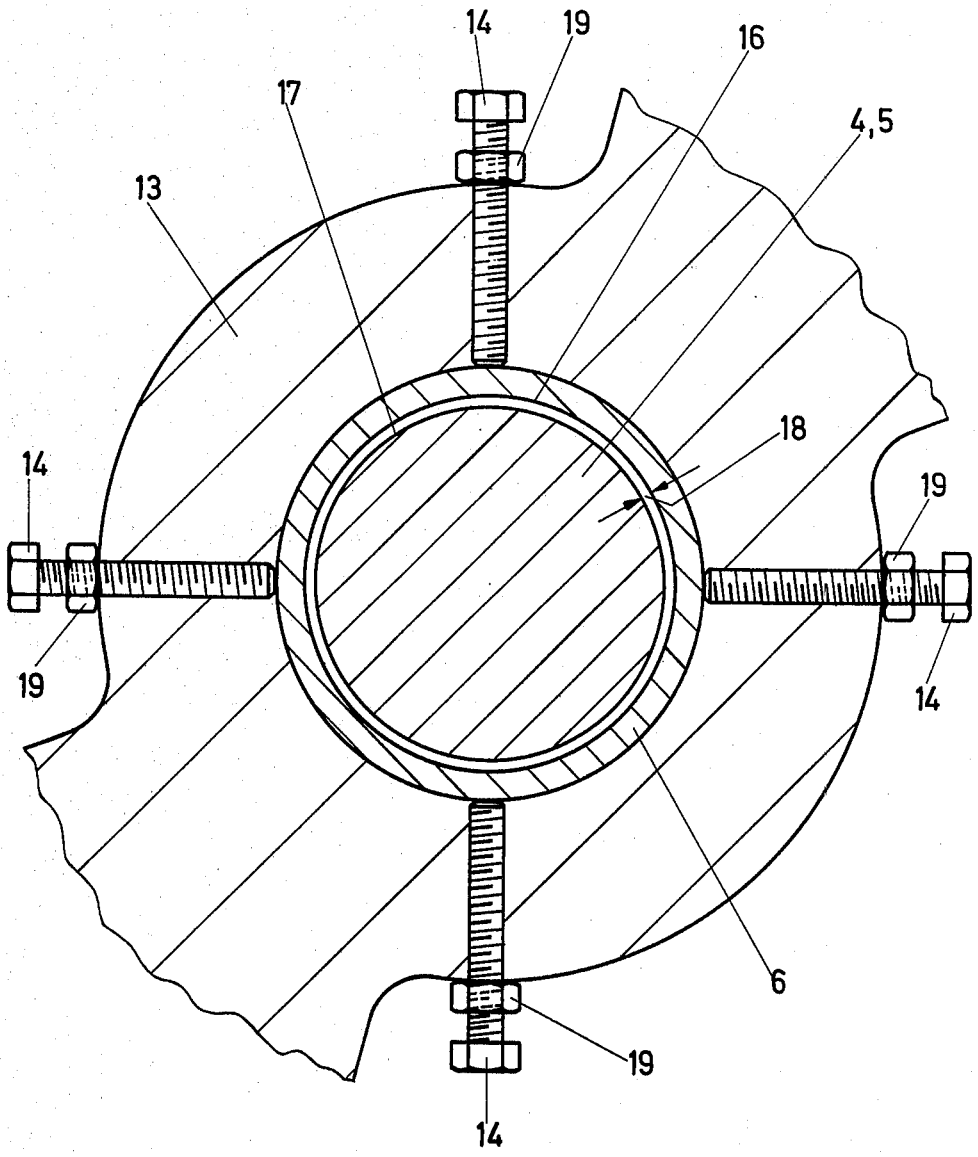
FIGS. 3 to 5 are similar enlarged fragmentary views of FIG. 1 showing a bearing of a hollow member disposed on the cylinder journal of the transfer cylinder with respectively varying settings of the setscrews.
Figure 4:
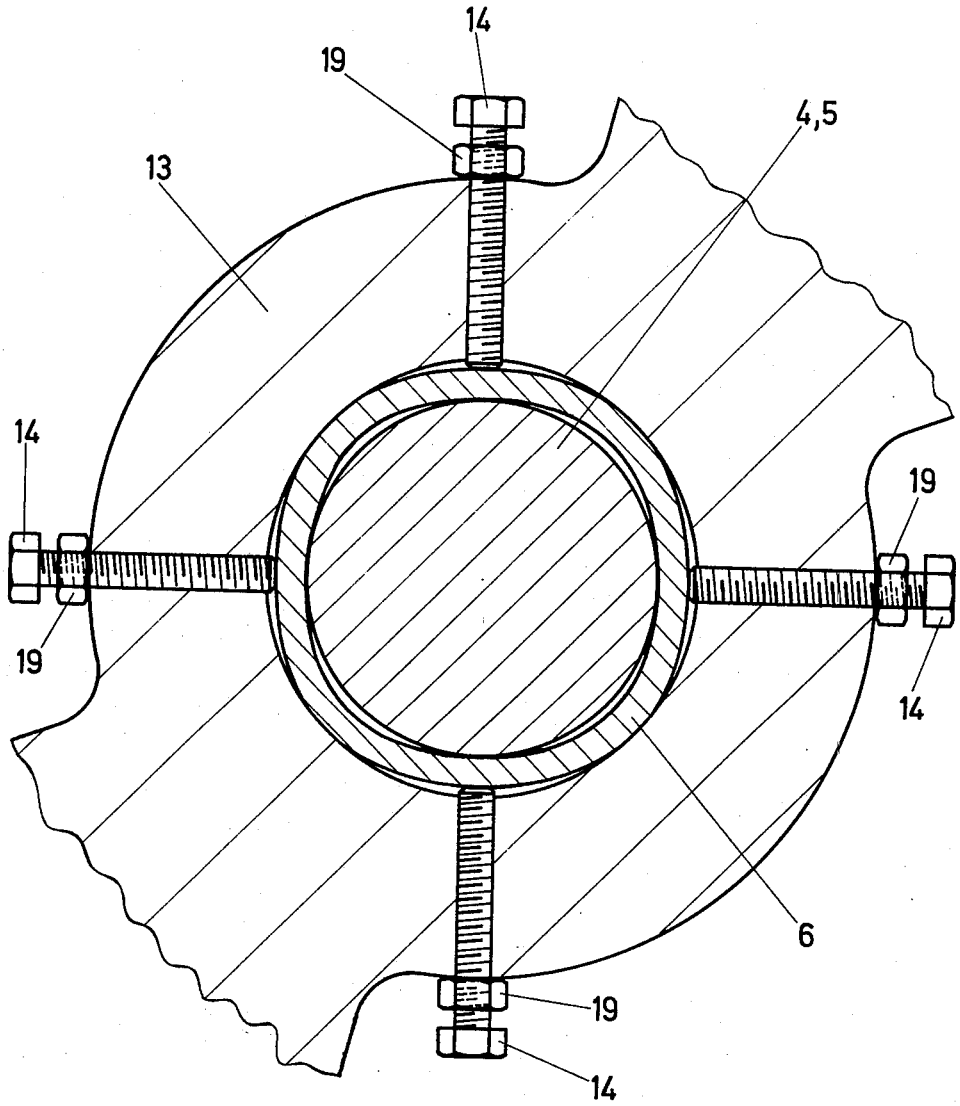
Figure 5:
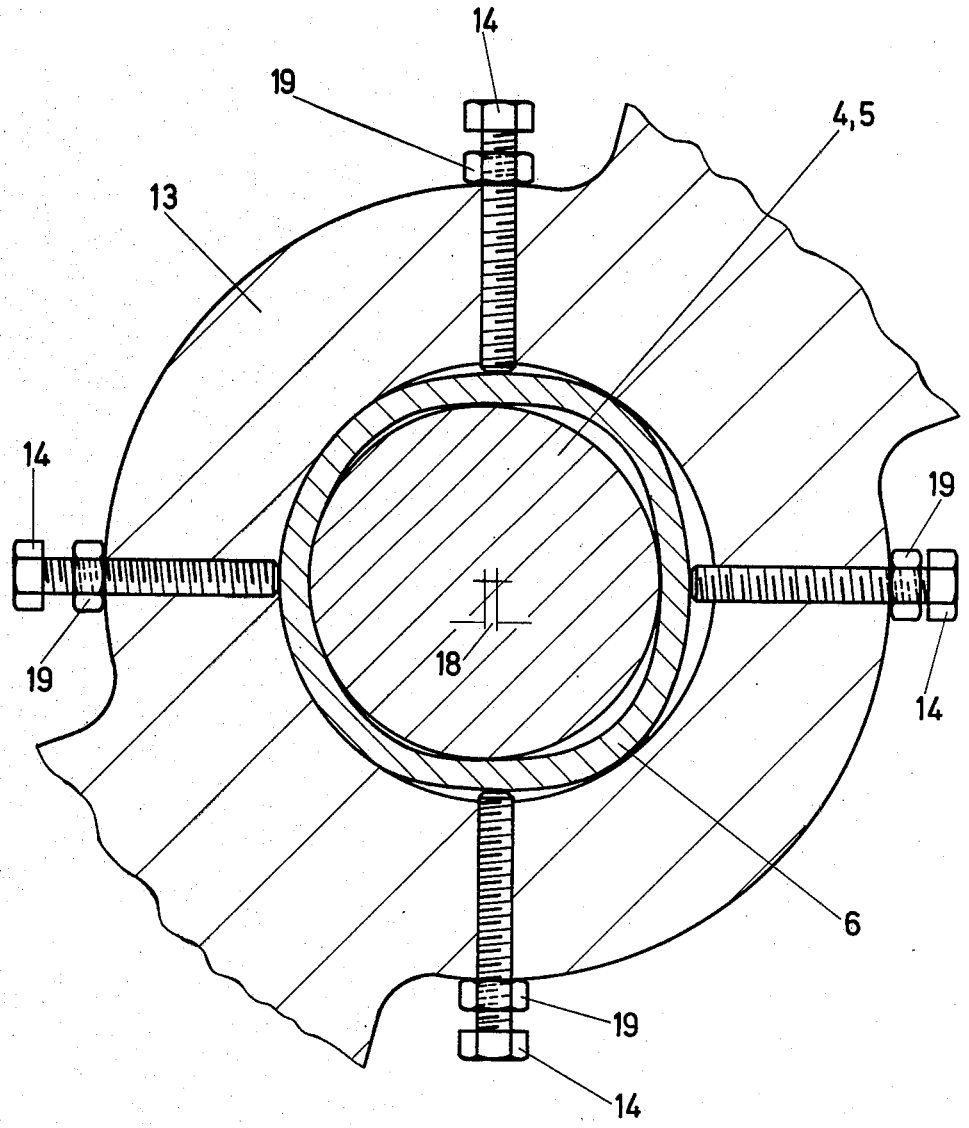

FIGS. 3, 4 and 5 show the special disposition of the bearing of the hollow member 2. As mentioned hereinbefore, the slide ring 6 is fastened by press-fit in the bearing hub 13. Play or spacing 18 of, for example, 0.05 mm is provided between the inner surface 16 of the slide ring 6 and the bearing surface 17 of the cylinder journal 4, 5. After lock nuts 19 on the setscrews or adjusting screws 14 have been loosened, all of the setscrews 14 are screwed into the setting thereof shown in FIG. 4. The slide ring 6 is accordingly deformed in the manner illustrated in FIG. 4. The result thereof is the local outward forcing of the play or clearance. The cylinder journals 4 and 5 are then adjusted free of play. The lock nuts 19 are again tightened. In this setting shown in FIG. 4, the transfer cylinder is installed into a perfector printing machine.

If double printing or mackling should occur due to the hereinaforementioned fault when printing with a perfector press, the hollow member 2 can be radially adjusted maximally over the entire play or clearance, the one sheet support 11 being lowered and the sheet support 11 located opposite thereto being radially outwardly raised. FIG. 5 shows the corresponding adjustment of the setscrews 14 and the slide ring 6. The setscrews 14 located respectively below and above in FIG. 5 remained, in this illustrated example, unaffected and untouched by the adjustment. Only the setscrew 14 at the left-hand side of FIG. 5 was unscrewed or screwed outwardly for a distance corresponding to the entire play or clearance, and the setscrew 14 at the right-hand side was screwed in the entire clearance depth. The result thereof is that the hollow member 2 is accordingly eccentrically mounted, with the eccentricity being equal to the play or clearance 18. Naturally, the hollow member 2 could, when needed, be eccentrically shifted, additionally, a distance corresponding to the same play or clearance 18 with the aid of the upper and lower setscrews 14, as shown in FIG. 5.

The shifting or adjustment of the sheet-supporting combs 10 of the hollow member 2 is sufficient for completely eliminating the occurrence of rhythmic double-printing or mackling phenomena.

Figure 6:
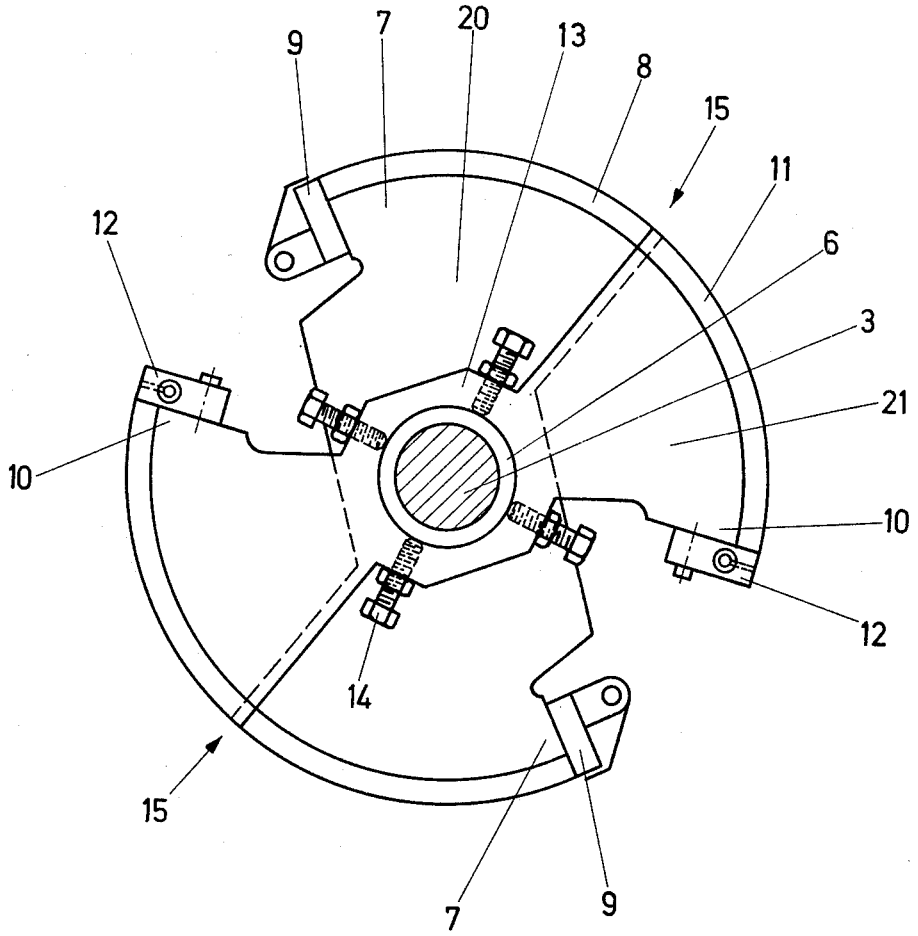
FIG. 6 is an enlarged side view of another embodiment of the transfer cylinder with two sheet-supporting surfaces formed of two groups of sheet-supporting segments slipped onto a shaft.
Figure 7:
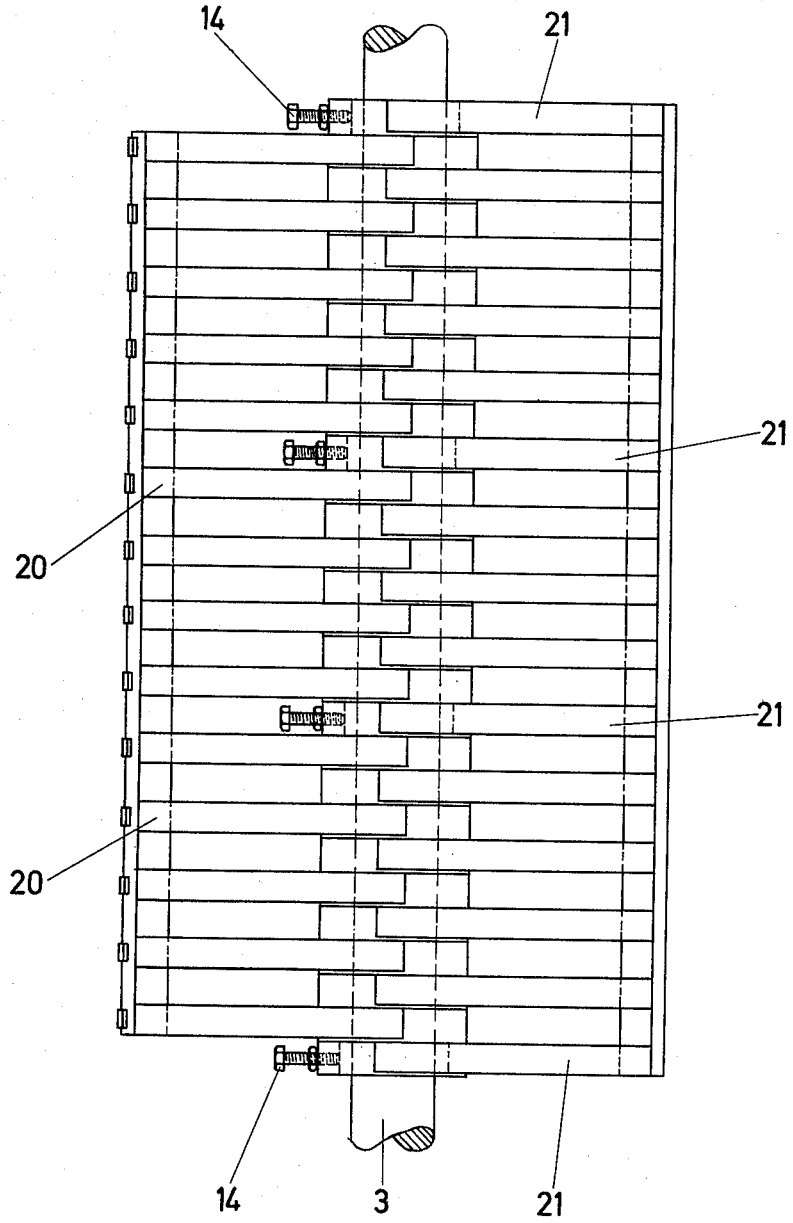
FIG. 7 is an axial view of FIG. 6 wherein four sheet-supporting segments are provided with setscrews at the bearings thereof.

FIGS. 6 and 7 show a transfer cylinder with two sheet supporting surfaces 15 wherein two groups of sheet supporting segments 20 and 21 are strung on the shaft 3 and, indeed, in a manner that the sheet supporting segments 20 and 21 alternate. The sheet supporting segments 20 are tightly mounted on the shaft 3 and are combined or united into sheet-supporting combs 7 by the diametrically opposing devices 9 for gripping the leading edge of a sheet.

The other sheet supporting segments 21 are similarly connected to one another and, in fact, through the device 12 for gripping the trailing edge of a sheet. The sheet supporting segments 21 thus form both diametrically opposing sheet-supporting combs 10.

Since all of the sheet-supporting segments 21 are mounted so as to be adjustable about the shaft 3, the sheet supports 8 and 11 of the sheet-supporting surfaces 15 can be slid into one another and, in the setting shown in FIG. 6, out of one another.

As can be concluded from FIG. 7, the bearing hubs 13 of four sheet supporting segments 21, which are disposed at a given spacing from one another, are rotatably disposed through the intermediary of a respective slide ring 6 on the shaft 3. The bearing hubs 13 of these sheet-supporting segments 21 have the hereinaforementioned setscrews 14 disposed symmetrically to the periphery. The construction of the bearing for all four sheet-supporting segments 21 provided with the setscrews 14 corresponds fully and entirely to those shown in FIGS. 3, 4 and 5.

The four sheet-supporting segments 21 provided with setscrews 14 can thus, when required, be radially adjusted. Since the remaining sheet-supporting segments 21 are mounted with given play or clearance and are altogether connected to one another by means of the device 12 for gripping the trailing edge of a sheet, the adjustment has an effect upon the entire sheet-supporting comb 10. Also, in the case of a transfer cylinder made up of individual sheet-support segments 20, 21, the possibility exists of compensating for form and revolving faults by adjusting several of the sheet-supporting segments 21 in accordance with the invention. Obviously, all of the adjustable sheet-supporting segments 21 can be mounted on the shaft 3 through the intermediary of a slide ring 6 with the aid of setscrews 14.

Figure 8:
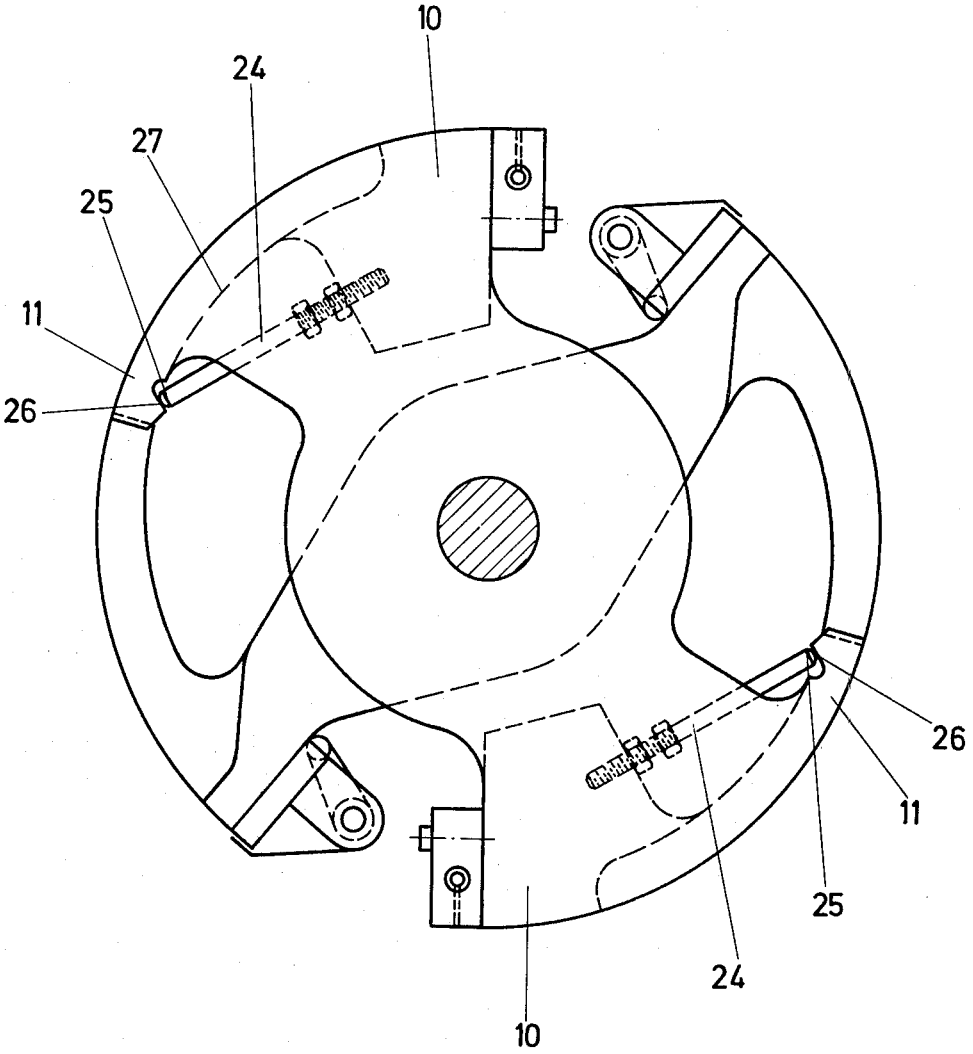
FIG. 8 is an enlarged side view of a third embodiment of the transfer cylinder according to the invention wherein the rear or trailing ends of the sheet supports are bendable radially outwardly by means of setscrews.

FIG. 8 also shows a basic construction of the transfer cylinder as has be described hereinbefore with respect to FIGS. 1 and 2. However, in FIG. 8, no possibilities of adjustment are provided either at both bearings of the hollow member 2 or in the sheet supporting surface 15 thereof. On the contrary, a setscrew 24 is respectively screwed into the sheet-supporting combs 10 at the level of each sheet support 11 in a manner that the free end 25 of the setscrew 24 engages a stop 26 which is provided practically at the end of the sheet support 11 at the inner edge 27 thereof. By screwing the set screws 24 out from the sheet-supporting comb 10 in direction toward the end of the sheet support 11, each of the sheet supports 11 can be bent radially outwardly and deformed. By means of this adjustment possibility, opportunity is also afforded for eliminating double printing or mackling phenomena which originate from form and rotation faults and increase in play due to improper handling of the printing machine during operation thereof.

Even with the most accurate manufacture of machine parts in the order of magnitude of transfer cylinders of the aforedescribed type, small manufacturing tolerances cannot be excluded as long as the economy or profitability of the production is to be maintained. The invention of the instant application offers the possibility of eliminating even the smallest manufacturing inaccuracies which could yet have a negative effect upon the printed image.

There are claimed:

1. In a transfer cylinder for perfector printing machines having two diametrically opposed sheet-supporting surfaces formed from two groups, respectively, of sheet supports engaging comb-like one within the other, one of the two sheet-supporting groups of one sheet-supporting surface having a device for gripping the leading edge of a sheet, and both of the sheet-supporting groups forming one sheet-supporting surface being adjustable relative to one another about the rotary shaft of the transfer cylinder, each of said sheet supports of a respective sheet-supporting surface being firmly connected to a diametrically opposing sheet support of the other sheet-supporting surface and being disposed on the shaft of the transfer cylinder, the improvement therein comprising means for mounting together at least a plurality of the diametrically opposing, mutually firmly connected sheet supports so as to be radially adjustable, said mounting means comprising at least one radially deformable slide ring carrying said sheet supports.

2. In a transfer cylinder for perfector printing machines having two diametrically opposed sheet-supporting surfaces formed from two groups, respectively, of sheet supports engaging comb-like one within the other, one of the two sheet-supporting groups of one sheet-supporting surface having a device for gripping the leading edge of a sheet, and both of the sheet-supporting groups forming one sheet-supporting surface being adjustable relative to one another about the rotary shaft of the transfer cylinder, each of said sheet supports of a respective sheet-supporting surface being firmly connected to a diametrically opposing sheet support of the other sheet-supporting surface and being disposed on the shaft of the transfer cylinder, the improvement therein comprising means for mounting together at least a plurality of the diametrically opposing, mutually firmly connected sheet supports so as to be radially adjustable, two diametrically opposing sheet-supporting groups forming a cylinder base member and each thereof having a device for gripping the leading edge of a sheet, both of the other sheet-supporting groups being disposed on a hollow member partly surrounding the cylinder base member and, respectively, having a device for gripping the trailing edge of a sheet, two cylinder journals provided on the cylinder base member and carrying respective slide rings, said hollow member being mounted on said cylinder journals through the intermediary of said slide rings, said slide rings and said cylinder journals having play therebetween, set screws disposed in said hollow member and acting upon said slide rings so as to deform the same for locally removing the play between the inner surface of said slide rings and the bearing surface of the respective cylinder journal and for radially adjusting the sheet supports.

3. Transfer cylinder according to claim 2 wherein said setscrews are disposed so as to act directly upon said bearing surface.

4. In a transfer cylinder for perfector printing machines having two diametrically opposed sheet-supporting surfaces formed from two groups, respectively, of sheet supports engaging comb-like one within the other, one of the two sheet-supporting groups of one sheet-supporting surface having a device for gripping the leading edge of a sheet, and both of the sheet-supporting groups forming one sheet-supporting surface being adjustable relative to one another about the rotary shaft of the transfer cylinder, each of said sheet supports of a respective sheet-supporting surface being firmly connected to a diametrically opposing sheet support of the other sheet-supporting surface and being disposed on the shaft of the transfer cylinder, the improvement therein comprising means for mounting together at least a plurality of the diametrically opposing, mutually firmly connected sheet supports so as to be radially adjustable, two diametrically opposing sheet-supporting groups being formed of sheet-supporting segments and each thereof having a device for gripping the leading edge of a sheet, both of the other sheet-supporting groups being likewise formed of individual sheet-supporting segments having a respective device for gripping the trailing edge of a sheet, at least a plurality of said sheet-supporting segments being mounted through the intermediary of a slide ring on said shaft, said slide ring and said shaft having play therebetween, set screws disposed in said sheet-supporting segments provided with the slide ring and acting upon the slide ring so as to deform the same for locally removing the play between the slide ring and the shaft and for radially adjusting the sheet-supporting segments.

5. Transfer cylinder according to claim 3 wherein said setscrews are disposed so as to act directly upon said shaft.

* * * * *